US007816852B2

(12) United States Patent
Chang et al.

(10) Patent No.: US 7,816,852 B2
(45) Date of Patent: Oct. 19, 2010

(54) ELECTRON EMISSION DISPLAY DEVICE WITH ANODE TERMINAL

(75) Inventors: Dong-Su Chang, Suwon-si (KR); Hyeong-Rae Seon, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 669 days.

(21) Appl. No.: 11/588,279

(22) Filed: Oct. 27, 2006

(65) Prior Publication Data

US 2008/0018223 A1 Jan. 24, 2008

(30) Foreign Application Priority Data

Oct. 31, 2005 (KR) ..... 10-2005-0103512

(51) Int. Cl.
*H01J 1/62* (2006.01)
*H01J 63/04* (2006.01)
*G09G 3/10* (2006.01)

(52) U.S. Cl. ..... 313/495; 315/169.1

(58) Field of Classification Search ..... None
See application file for complete search history.

(56) References Cited

U.S. PATENT DOCUMENTS

| | | | |
|---|---|---|---|
| 5,965,978 | A | 10/1999 | Kishino |
| 6,831,402 | B2 | 12/2004 | Kamiguchi |
| 2004/0130259 | A1 | 7/2004 | Kamiguchi |
| 2005/0023958 | A1 | 2/2005 | Kamiguchi |

FOREIGN PATENT DOCUMENTS

| | | | |
|---|---|---|---|
| CN | 1109208 | | 9/1995 |
| JP | 62-205320 | | 9/1987 |
| JP | 10-031433 | | 2/1998 |
| JP | 2000-195449 | A | 7/2000 |
| JP | 2000-323076 | | 11/2000 |
| JP | 2003-029660 | A | 1/2003 |
| JP | 2003-229080 | | 8/2003 |
| JP | 2004-111376 | | 4/2004 |
| JP | 2004-327052 | | 11/2004 |
| JP | 2005-049365 | A | 2/2005 |
| JP | 2005-158498 | | 6/2005 |
| JP | 2005-251761 | | 9/2005 |

OTHER PUBLICATIONS

*Search Report* from the European Patent Office issued on Jan. 23, 2008 corresponding to European Patent Application No. 06123142.9.

Japanese Office Action dated Nov. 4, 2009 for the corresponding Japanese Patent Application No. 2006-296053.

*Primary Examiner*—Toan Ton
*Assistant Examiner*—Britt D Hanley
(74) *Attorney, Agent, or Firm*—Robert E. Bushnell, Esq.

(57) ABSTRACT

An electron emission display includes first and second substrates facing each other to form a vacuum envelope, an electron emission unit formed on the first substrate, and a light emission unit formed on the second substrate. The light emission unit includes an anode electrode formed on the second substrate and electrically connected to at least one anode terminal to receive an anode voltage from the anode terminal, and the anode terminal is arranged on a side of the first substrate external to the vacuum envelope and in parallel to the first substrate.

20 Claims, 9 Drawing Sheets

ELECTRON EMISSION DISPLAY DEVICE WITH ANODE TERMINAL

CLAIM OF PRIORITY

This application makes reference to, incorporates the same herein, and claims all benefits accruing under 35 U.S.C. §119 from an application earlier filed in the Korean Intellectual Property Office on 31 Oct. 2005 and there duly assigned Serial No. 10-2005-0103512.

BACKGROUND OF THE INVENTION

1. Field of the Invention

The present invention relates to an electron emission display, and more particularly, to a structure for supplying a voltage to an anode electrode of the electron emission display.

2. Description of the Related Art

Generally, electron emission elements arrayed on electron emission devices are classified into those using hot cathodes as an electron emission source, and those using cold cathodes as the electron emission source.

There are several types of cold cathode electron emission elements, including Field Emitter Array (FEA) elements, Surface Conduction Emitter (SCE) elements, Metal-Insulator-Metal (MIM) elements, and Metal-Insulator-Semiconductor (MIS) elements.

The MIM element includes first and second metal layers and an insulation layer interposed between the first and second metal layers. In the MIM element, when a voltage is supplied between the first and second metal layers, electrons generated from the first metal layer reach the second metal layer through the insulation layer by a tunneling phenomenon. Among the electrons reaching the second metal layer, some electrons that have a higher energy than a work function of the second metal layer are emitted from the second metal layer.

The MIS element includes a metal layer, a semiconductor layer, and an insulation layer interposed between the metal layer and the semiconductor layer. In the MIS element, when a voltage is supplied between the metal layer and the semiconductor layer, electrons generated from the semiconductor layer reach the metal layer through the insulation layer by a tunneling phenomenon. Among the electrons reaching the metal layer, some electrons that have a higher energy than a work function of the metal layer are emitted from the metal layer.

The SCE element includes first and second electrodes facing each other and a conductive layer disposed between the first and second electrodes. Fine cracks are formed on the conductive layer to form the electron emission regions. When a voltage is supplied to the first and second electrodes to allow a current to flow along a surface of the conductive layer, electrons are emitted from the electron emission regions.

The FEA elements use a theory in which, when a material having a relatively lower work function or a relatively large aspect ratio is used as the electron source, electrons are effectively emitted by an electric field in a vacuum. Recently, the electron emission regions have been formed of a material having a relatively lower work function or a relatively large aspect ratio, such as a molybdenum-based material, a silicon-based material, and a carbon-based material such as carbon nanotubes, graphite, and diamond-like carbon so that electrons can be effectively emitted when an electric field is supplied thereto in a vacuum. When the electron emission regions are formed of the molybdenum-based material or the silicon-based material, they are formed in a pointed tip structure.

A typical electron emission display includes an array of electron emission elements formed on a first substrate and a light emission unit formed on a second substrate. The light emission unit includes phosphor layers and an anode electrode.

The electron emission display includes electron emission regions formed on the first substrate and driving electrodes formed on the first substrate to control the electron emission for each pixel. The anode electrode formed on the second substrate functions to allow the electrons emitted from the electron emission regions formed on the first substrate to be effectively accelerated toward the phosphor layers. Accordingly, the electrons emitted from the electron emission regions excite the phosphor layers to display an image.

The anode electrode receives a direct current voltage of, for example, hundreds through thousands of positive volts that can accelerate the electrons emitted from the first substrate to the second substrate. The voltage is supplied from an input terminal. The input terminal extends from the anode electrode to an edge of the second substrate to be placed external to the vacuum envelope.

Therefore, the second substrate must be provided with a portion on which the input terminal will be disposed. In the conventional electron emission display, one side edge of the second substrate protrudes to provide the portion on which the input terminal will be placed.

The second substrate has an extending portion that extends over the sealing member. The input terminal has a first end contacting the anode electrode and a second end disposed on the extending portion of the second substrate over the seal member.

As described above, in order to supply the voltage to the anode electrode, the second substrate is provided with the extending portion protruding further than the first substrate. This causes an increase of the overall size of the electron emission display.

That is, in the conventional electron emission display, the extending portion of the second substrate functions to only provide the portion for placing the input terminal. The extending portion is a non-active area where the image is not displayed. That is, the extending portion is a dead space that increases the overall size of the display, thereby making it difficult for the display to be compact.

SUMMARY OF THE INVENTION

The present invention provides an electron emission display that can minimize a space taken up by an input terminal of an anode electrode, thereby reducing unnecessary space other than an active area for displaying an image.

In an exemplary embodiment of the present invention, an electron emission display is provided including: first and second substrates facing each other to define a vacuum envelope; an electron emission unit arranged on the first substrate; and a light emission unit arranged on the second substrate, the light emission unit including an anode electrode arranged on the second substrate and electrically connected to at least one anode terminal to receive an anode voltage from the anode terminal, the anode terminal being arranged on a side of the first substrate external to the vacuum envelope and parallel to the first substrate.

A lead line connected to the anode terminal is preferably arranged on the first substrate within the vacuum envelope, and the lead line and the anode electrode are preferably electrically interconnected by a connecting member.

The connecting member preferably contacts a part of the anode electrode. The connecting member preferably contacts an extending portion of the anode electrode.

A crossed region is preferably defined where the extending portion faces the lead line, and the connecting member is preferably arranged within the crossed region.

The extending portion preferably includes a plurality of individual extending portions. The extending portion crosses the lead line at right angles.

The lead line preferably includes a material selected from a group consisting of Cr, Al, Ag, ITO, and combinations thereof.

The extending portion preferably includes a material selected from a group consisting of Cr, Al, Ag, ITO, and combinations thereof.

The connecting member is preferably fixed to at least one of the anode electrode and the lead line by an electrically conductive adhesive. The connecting member preferably includes an electrically conductive spacer. The connecting member preferably includes an electrically conductive elastic body. The connecting member preferably includes a coil spring. The connecting member preferably includes a spring having a diamond-shaped cross-section. The connecting member preferably includes a leaf spring having a bent centerline. The connecting member preferably includes a resistive material.

The first and second substrates are preferably coupled to each other by a sealing member, and the anode terminal is arranged close to the sealing member on the first substrate.

An edge of the first substrate is preferably either coincident with an edge of the second substrate, or is arranged inside the edge of the second substrate.

The anode terminal is preferably arranged on an extending portion of the first substrate, which extends to a side of the second substrate external to the vacuum envelope. The anode terminal preferably contacts the anode electrode and is preferably electrically connected to a connecting member passing through an exhaust hole arranged on the first substrate.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention is described more fully with below reference to the accompanying drawings, in which exemplary embodiments of the present invention are shown. The present invention can, however, be embodied in many different forms and should not be construed as being limited to the embodiments set forth herein; rather these embodiments are provided so that this disclosure will be thorough and complete, and will fully convey the concept of the present invention to those skilled in the art.

Figure 1:
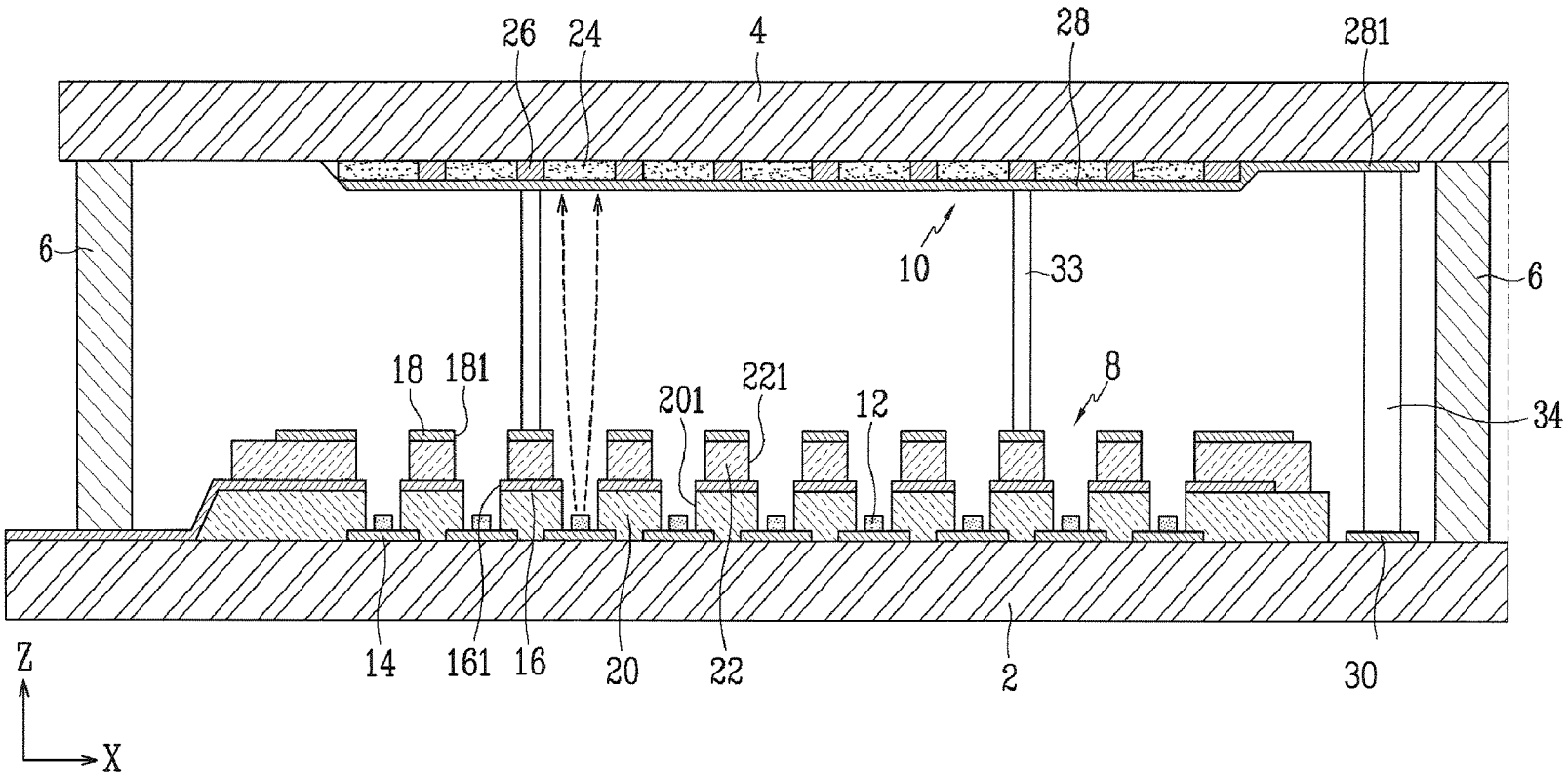
FIG. 1 is a sectional view of an electron emission display according to a first embodiment of the present invention.
Figure 2:
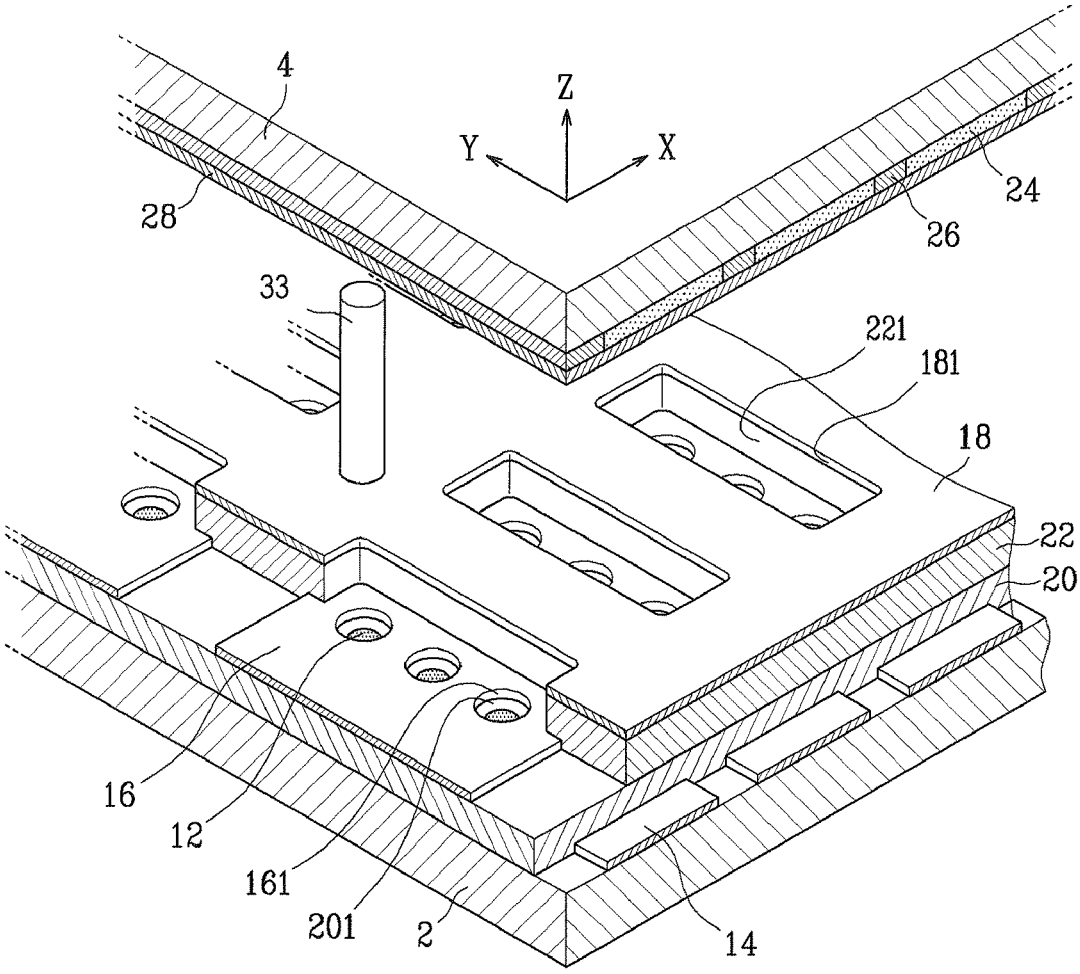
FIG. 2 is an exploded perspective view of the electron emission display of FIG. 1.
Figure 3:
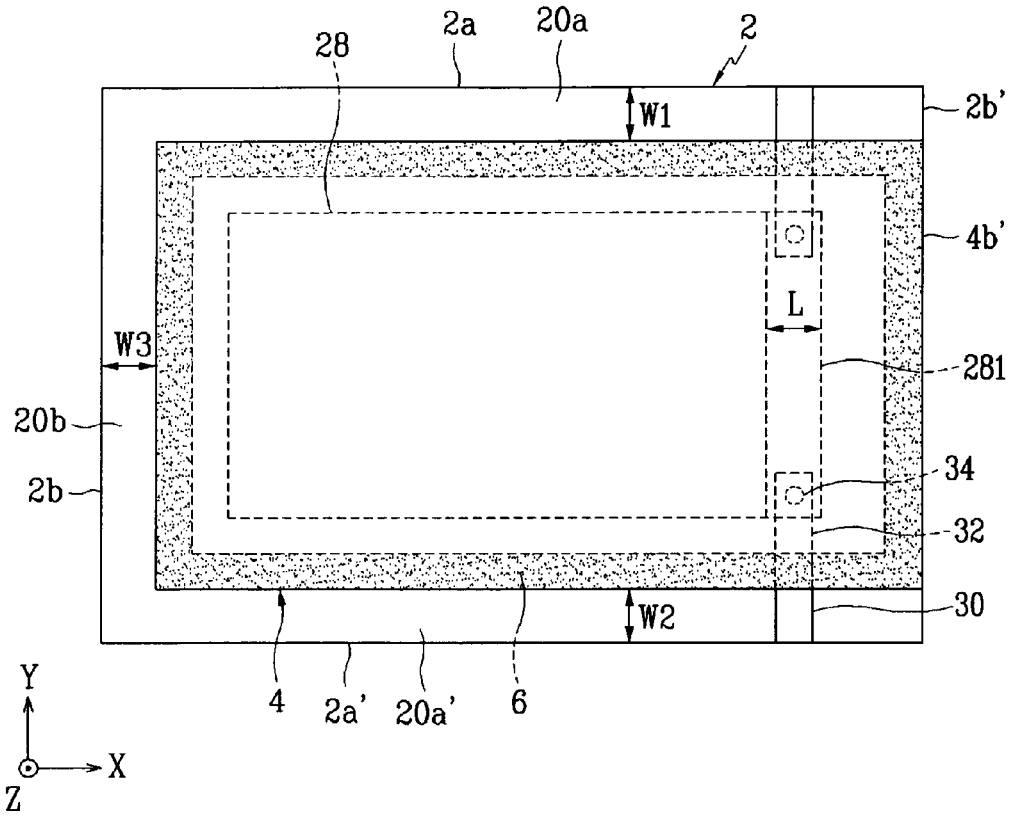
FIG. 3 is a top view of a major portion of the electron emission display of FIG. 1.

FIG. 1 is a sectional view of an electron emission display according to a first embodiment of the present invention, FIG. 2 is an exploded perspective view of the electron emission display of FIG. 1, and FIG. 3 is a top view of a major portion of the electron emission display of FIG. 1.

Referring to FIGS. 1 through 3, an electron emission display according to an embodiment of the present invention includes first and second substrates 2 and 4 facing each other and spaced apart from each other by a predetermined distance. A sealing member 6 is provided at the peripheries of the first and second substrates 2 and 4 to seal them together. Therefore, the first and second substrates 2 and 4 and the sealing member 6 form a vacuum envelope.

The sealing member 6 can be formed of bar-shaped frit glass. Alternatively, the sealing member 6 includes a glass frame disposed between the first and second substrates 2 and 4 and frit glass deposited between the glass frame and each of the first and second substrates 2 and 4.

An electron emission unit 8 is formed on the first substrate 2 to emit electrons toward the second substrate. A light emission unit 10 is provided on the second substrate 4 to emit visible light rays by being excited by the electrons emitted from the electron emission unit 8.

The electron emission unit 8 and the light emission unit 10 are respectively formed at an active area of the first and second substrates 2 and 4. The sealing member is formed to surround the active area.

In this embodiment, the electron emission unit 8 and the light emission unit 10 are structured to be used in an electron emission display having an array of FEA elements.

Describing the electron emission unit 8 in more detail, electron emission regions 12, cathode and gate electrodes 14 and 16 for controlling the electron emission of the electron emission regions 12 are formed on the first substrate 2. A focusing electrode 18 for focusing electron beams is formed over the cathode and gate electrodes 14 and 16.

In this embodiment, the cathode electrodes 14 are formed in a stripe pattern extending in a direction (along a Y-axis in FIG. 1) and a first insulation layer 20 is formed on the first substrate 2 to cover the cathode electrodes 14. The gate electrodes 16 are formed on the first insulation layer 20 in a stripe pattern extending in a direction (along an X-axis in FIG. 1) to cross the cathode electrodes 14 at right angles.

The crossed regions of the cathode electrodes 14 and the gate electrodes 16 define pixel regions. Each pixel region has one or more electron emission regions 12. Openings 161 and 201 corresponding to the electron emission regions 20 are formed through the first insulation layer 20 and the gate electrodes 16 to expose the electron emission regions 12. The electron emission regions 12 are formed of a material that emits electrons when an electric field is supplied thereto in a vacuum, such as a carbonaceous material or a nanometer-sized material.

For example, the electron emission regions 12 can be formed of carbon nanotubes, graphite, graphite nanofibers, diamonds, diamond-like carbon, $C_{60}$, silicon nanowires, or a combination thereof.

Alternatively, the electron emission regions 12 can be formed of a molybdenum-based material or a silicon-based material. The electron emission regions can be formed in a pointed tip structure.

One of the cathode and gate electrodes 14 and 16 serves as scan electrodes that receive a scan drive voltage, and the other functions as data electrodes that receive a data drive voltage. Then, electric fields are formed around the electron emission regions 12 where a voltage difference between the cathode and gate electrodes 14 and 16 is equal to or higher than a threshold value, and electrons are emitted from the electron emission regions 12.

This embodiment offers an example where the gate electrode 16 is disposed above the cathode electrodes with the first insulation layer 20 interposed therebetween. However, the present invention is not limited thereto. That is, the cathode electrodes 14 can be disposed above the gate electrodes 16. In this case, the electron emission regions can be formed on the first insulation layer while contacting a surface of the cathode electrodes.

A second insulation layer 22 is formed on the first insulation layer 20 to cover the gate electrodes 16, and the focusing electrode 18 is formed on the second insulation layer 22. Openings 181 and 221 are formed through the focusing electrode 18 and the second insulation layer 22 to expose the electron emission regions 12. The openings 181 and 221 are formed for each pixel region.

Describing the light emission unit in more detail, phosphor layers 24 and black layers 26 for enhancing the contrast of the image are formed on a surface of the second substrate 4 facing the first substrate 2. An anode electrode 28 that is a metal layer formed of aluminum, for example, is formed on a surface of the phosphor and black layers 24 and 26.

The anode electrode 28 functions to heighten the screen brightness by receiving a high voltage that is required for accelerating the electron beams and reflecting the visible light rays radiated from the phosphor layers 24 to the first substrate 2 toward the second substrate 4. The anode electrode 28 is disposed at the active area of the second substrate 4.

The anode electrode 28 can be a transparent conductive layer formed of Indium Tin Oxide (ITO), for example, other than the metal layer. In this case, the anode electrode is formed on surfaces of the phosphor and black layers that face the second substrate 4.

Spacers 33 are disposed between the first and second substrates 2 and 4 for uniformly maintaining a gap between the first and second substrates 2 and 4 against an outer force. The spacers 33 can be formed in a cylindrical shape or a wall-shape.

The anode electrode 28 receives an anode voltage through an anode terminal 30 arranged in parallel with the first substrate 2.

The above-described electron emission display is driven when a predetermined voltage is supplied to the cathode, gate, focus, and anode electrodes 14, 16, 18 and 28. The anode terminal 30 is formed on a surface of the first substrate 2, which faces the second surface 4, and has an end exposed to an external side of the vacuum envelope i.e., the sealing member 6.

One or more anode terminals 30 are provided and spaced apart from the electron emission unit by a sufficient distance so as to avoid mutual electrical interaction with the electron emission unit.

The anode terminal 30 is connected to a lead line 32 formed in the vacuum envelope. The lead line 32 is formed to partly face an extending portion 281 of the anode electrode 29.

Therefore, the lead line 32 and the extending portion 281 of the anode electrode 28 have a crossing area along a thickness (a Z-axis direction in FIG. 3) of the substrates 2 and 4. For example, as shown in FIG. 3, there can be an area where an end portion of the lead line 32 faces the extending portion 281 that extends from a side of the anode electrode 28 out of the active area by a length L.

The anode terminal 30 and the lead line 32 are separately formed from or with each other, or are integrally formed with each other. The extending portion of the anode electrode 28, the anode terminal 30, and the lead line 32 can be formed through a sputtering process, a vacuum deposition process, or a screen-printing process using Cr, Al, Ag, ITO, or a combination thereof.

In this embodiment, the extending portion 281 of the anode electrode 28 and the lead line 32 are electrically connected to a connecting member 34. As a result, the extending portion 281 is electrically connected to the lead line 32. The connecting member 34 is vertically arranged at the crossing area of the extending portion 281 of the anode electrode 28 and the lead line 32. That is, the connecting member 34 has opposite ends respectively contacting the extending portion 281 and the lead line 32.

The connecting member 34 is formed in a cylindrical shape having a cross-section formed in a circular, rectangular, or cross shape. The connecting member 34 is formed of an electrically conductive material. The connecting member 34 can also function as the spacer.

When there is no area where the extending portion 281 crosses the lead line 32, the connecting member 34 can be inclined rather than being vertical to connect the extending portion 281 to the lead line 32.

The connecting member 34 is securely fixed to the extending portion 281 and the lead line 32 by an adhesive. More particularly, the adhesive can contain an electrically conductive material, such as Ag, so as to reduce the contact resistance between the connecting member 34 and the extending portion 281 of the anode electrode 28 and between the connecting member 34 and the lead line 32.

In order to prevent arcing caused by the electrical effects of the anode voltage supplied to the anode electrode 28, the connecting member 34 is coated with a resistive layer or the connecting member 34 is formed of a resistive material.

The resistive material is selected from materials that are low in outgas, heat generation, and resistive variation relative to the high frequency. That is, the connecting member can be formed of a resistive material selected from the group consisting of a carbon-based material, a metal-alloy material, such as Nichrome (Ni—Cr), and a semiconductor-based material, such as Si.

In normal operation, the connecting member 34 reduces the anode voltage by 0.5-1%. When current is excessively generated by arcing, the connecting member 34 reduces the anode voltage by 5-10% to have a resistance value that can prevent arcing. For example, when the electron emission display operates under a condition where the anode current is 1-10 mA and the anode voltage is 5-10 kV, the resistance of the connecting member 34 can be 10-100 kΩ.

In addition, in order to shield an electric field generated by the anode electrode 28, a shielding wall can be installed on a side of the connecting member 34.

Describing the voltage supplying structure of the anode electrode in more detail with reference to FIG. 3, when the first substrate 2 is coupled to the second substrate 4 by the sealing member 6, extending portions 20*a*, 20*a*', and 20*b* that protrude further than the second substrate 4 are defined.

For example, the first substrate 2 has opposite longitudinal edges 2*a* and 2*a*', and one of lateral edges 2*b* extends outward from the sealing member 6 to form the extending portions 20*a*, 20*a*' and 20*b*. The other of the lateral edges 2*b* can be coincident with the corresponding lateral edge of the second substrate 4 (see FIG. 3) or disposed inward from the corresponding lateral edge of the second substrate 4.

The extending portions 20*a* and 20*a*', having respectively widths W1 and W2, provide an area where cathode pads (not shown) connected to the cathode electrodes can be placed. The extending portion 20*b*, having a width W3, provides an area where gate pads (not shown) connected to the gate electrodes can be placed.

The anode electrode has the extending portion 281 that extends in a longitudinal direction (along the X-axis in FIG. 3) of the second substrate 4 while the lead line 32 is disposed in a lateral direction (along the Y-axis in FIG. 3) of the second substrate 4 when a portion of the lead line 32 faces the anode electrode 28. The anode terminals 30 are arranged on the extending portions 20*a* and 20*a*' of the first substrate 2 and connected to the lead line 32.

As described above, in the electron emission display according to this embodiment, the anode electrode 28 extends to be closest to an inner surface of the sealing member 6 within a range where there is no electrical property problem between the anode electrode 28 and the sealing member, and the anode terminal 30 is placed on the extending portion of the first substrate 2.

Therefore, there is no need to form the anode terminal 30 on the second substrate 4 at an external portion of the sealing member 6. That is, since the anode terminal is not arranged on the substrate (the second substrate in this embodiment) on which the anode electrode is formed, a space taken by the anode terminal can be eliminated from the second substrate.

Other embodiments will now be described. Wherever possible, the same reference numbers will be used throughout the drawings to refer to the same or like parts.

Figure 4:
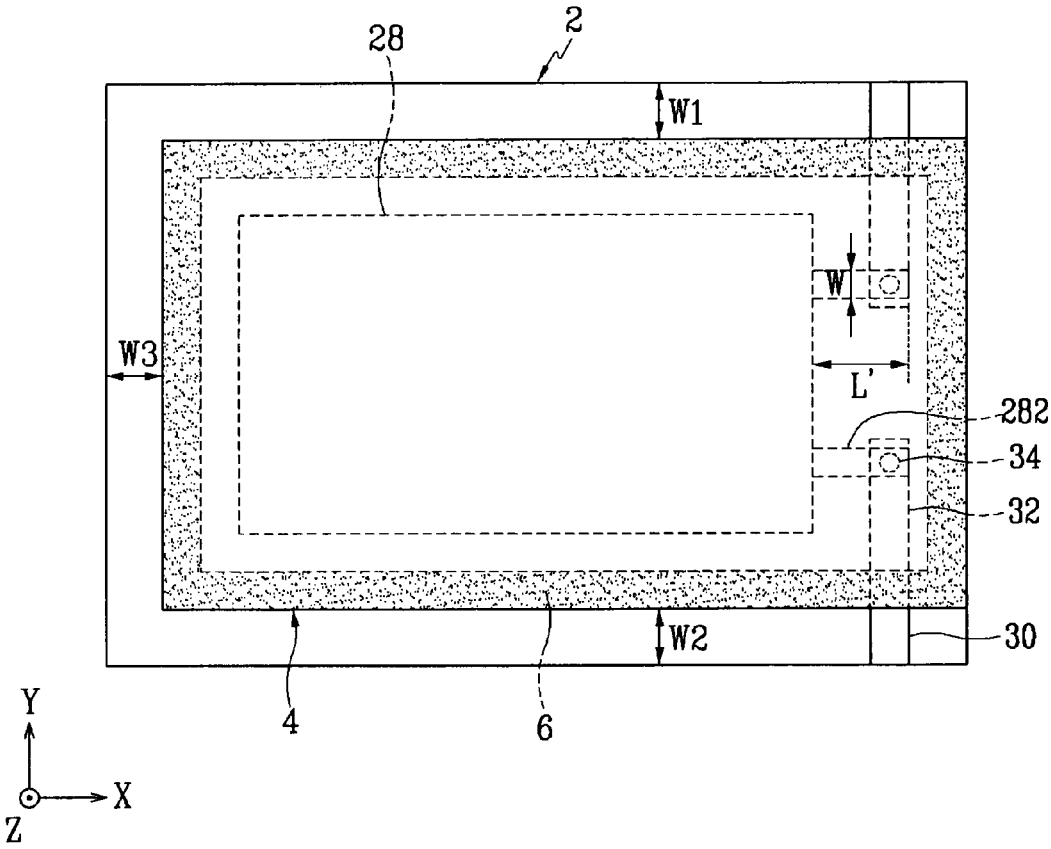
FIG. 4 is a top view of a major portion of an electron emission display according to a second embodiment of the present invention.

FIG. 4 is a top view of a major portion of an electron emission display according to a second embodiment of the present invention.

As shown in FIG. 4, the anode electrode 28 has a plurality of extending portions 282 each having a width W and a length L', and the extending portions 282 are connected to a side of the anode electrode 28 on the second substrate 4. The lead lines 32 are formed on the first substrate 2 to partly face the extending portions 282. The lead lines 32 are connected to the anode terminal 30.

An extending portion 282 of the anode electrode 28 and the lead line 32 do not necessarily cross each other in a vertical direction. The extending portion 282 and the lead line 32 cross each other at a variety of angles.

The crossed area of the extending portion 282 and the lead line 32 can be formed near their end portions. However, the present invention is not limited thereto. As long as they cross each other, the location of the crossed area can vary.

A connecting member 34 is placed at the crossed area of the extending portion 282 and the lead line 32.

Figure 5:
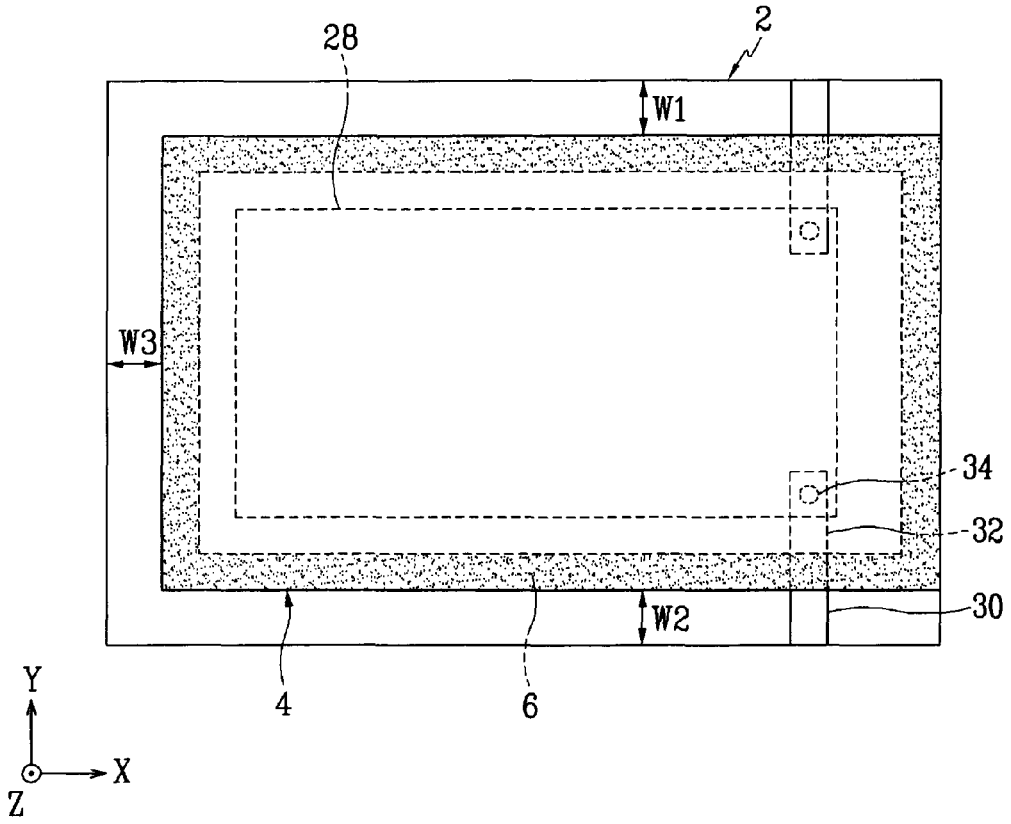
FIG. 5 is a top view of a major portion of an electron emission display according to a third embodiment of the present invention.

FIG. 5 is a top view of a major portion of an electron emission display according to a third embodiment of the present invention.

Referring to FIG. 5, no extending portion is provided on the anode electrode 28. That is, the anode electrode 28 is directly connected to the connecting member 34 to receive the anode voltage through the lead line 32 and the anode terminal 30.

In this embodiment, unlike the foregoing embodiments, since no extending portion is provided on the anode electrode 28, the manufacturing process can be simplified.

Figure 6:
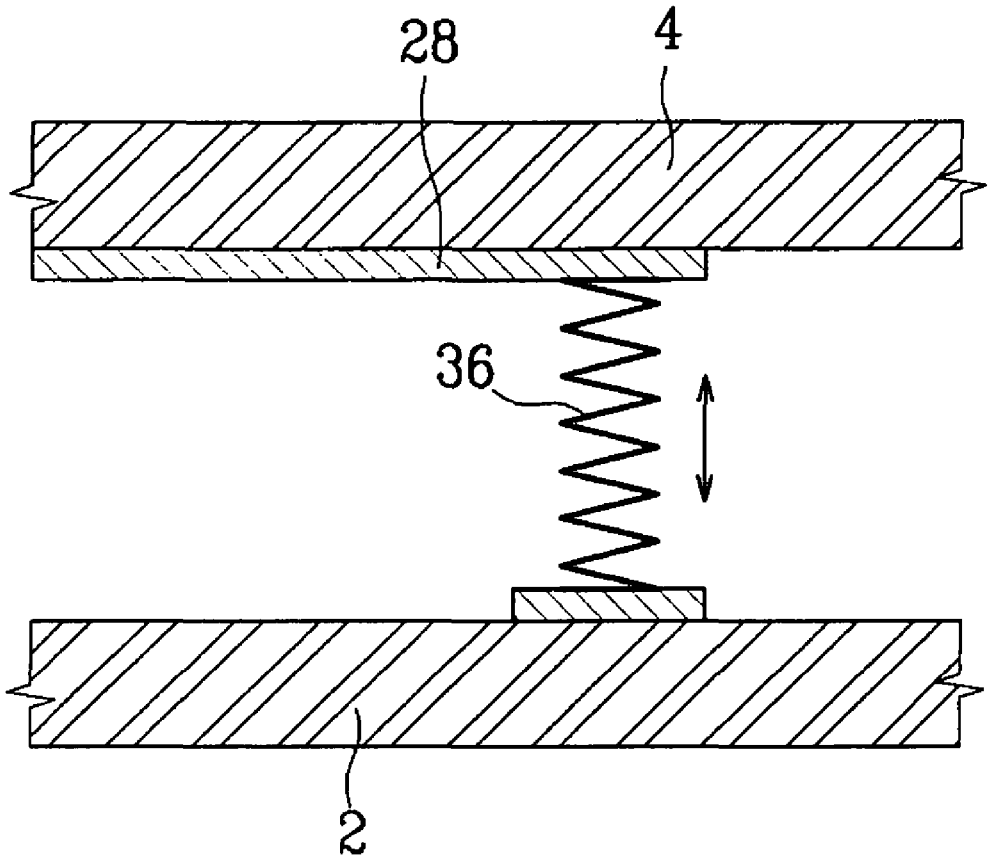
FIGS. 6 through 8 are partial sectional views of a variety of modified examples of a connecting member of the electron emission display of the present invention.
Figure 7:
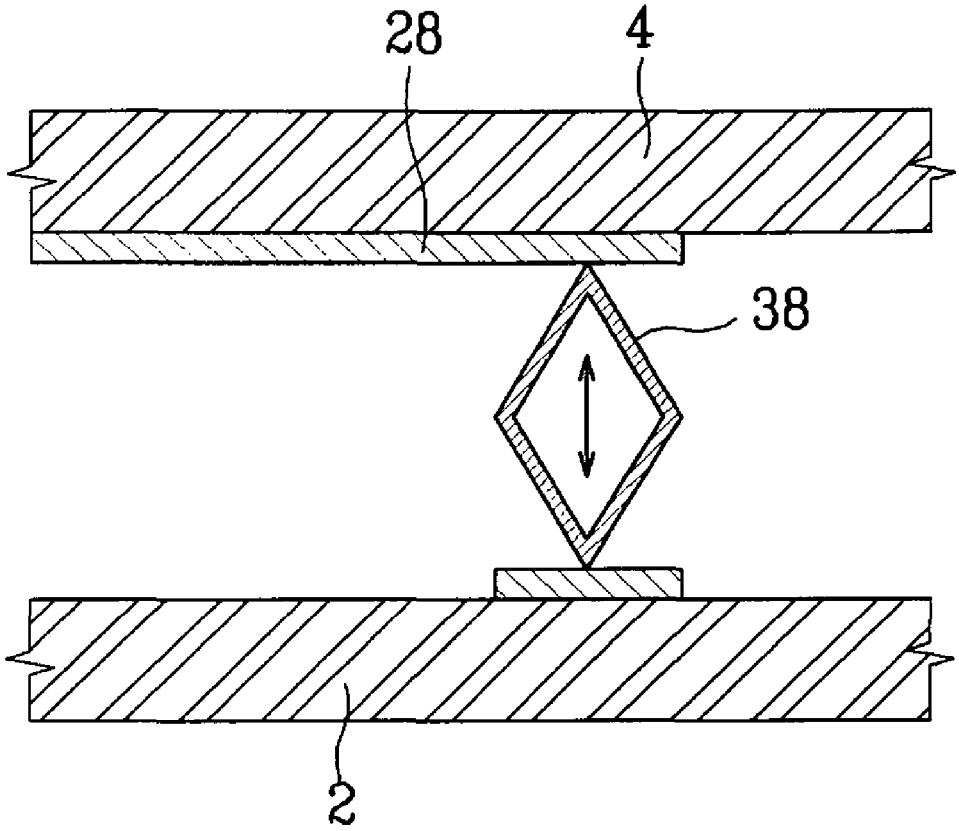
Figure 8:
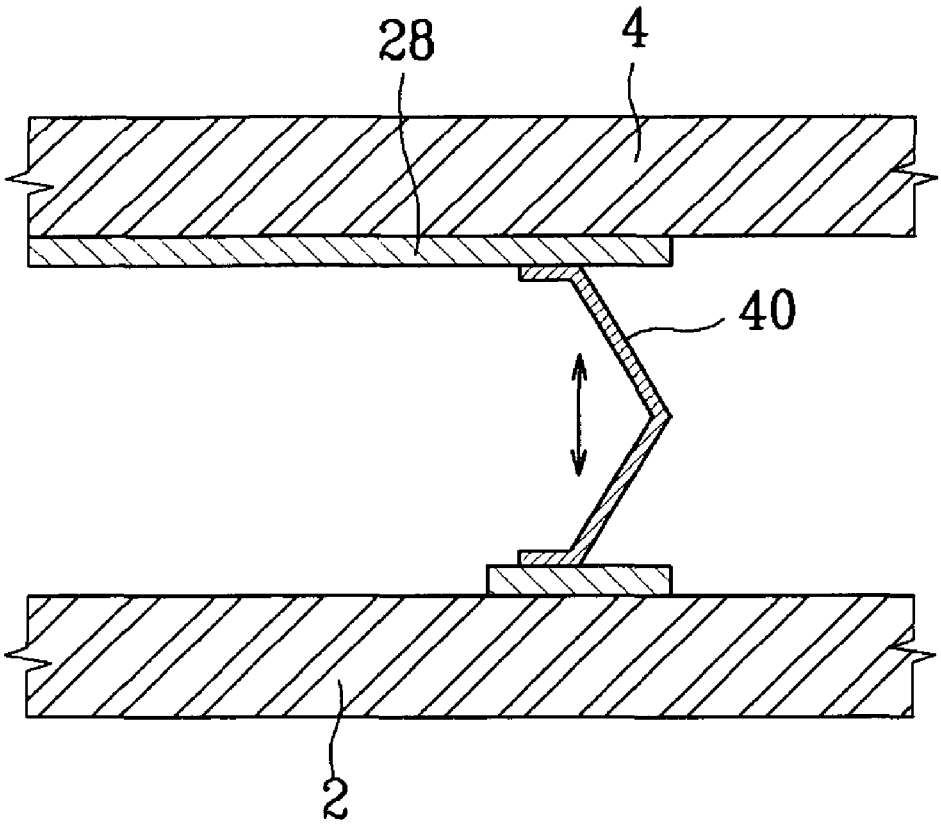

FIGS. 6 through 8 are partial sectional views of a variety of modified examples of the connecting member of the electron emission display in accordance with embodiments of the present invention.

The connecting member can be formed of an electrically conductive elastic body such as spring. The spring can have various shapes.

Referring first to FIG. 6, the connecting member 36 can be a coil spring. Alternatively, as shown in FIG. 7, the connecting member 36 can be a spring having a diamond-shaped cross-section. Alternatively, as shown in FIG. 8, the connecting member 40 can be a leaf spring having a bent centerline.

When the connecting member 36 is formed of an elastic body as described above, in the sealing process for coupling the first and second substrates 2 and 4 to each other by pressing one of the first and second substrates 2 and 4 toward the other, the height thereof may vary. Therefore, a manufacturing error occurring during the sealing process can be corrected by the connecting member being an elastic body, thereby improving the quality of the electron emission display.

In the foregoing embodiments, the anode terminal 30 is formed on a surface of the first substrate 2 facing the second substrate 4. However, the present invention is not limited thereto. That is, the anode terminal can be formed on a surface of the first substrate 2 that does not face the second substrate 4.

Figure 9:
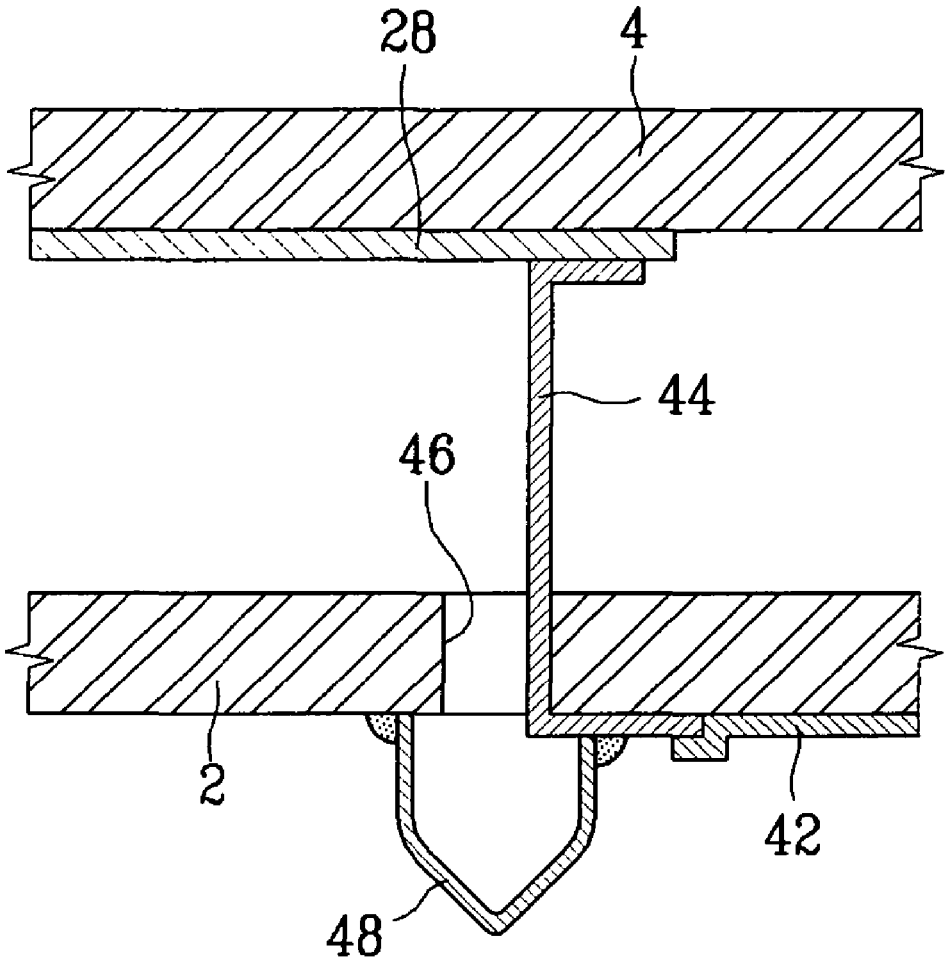
FIG. 9 is a partial sectional view of an electron emission display according to a fourth embodiment of the present invention.

FIG. 9 is a partial sectional view of an electron emission display according to a fourth embodiment of the present invention.

Referring to FIG. 9, an anode electrode 28 is electrically connected to an anode terminal 42 through a connecting member 44. The connecting member penetrates the first substrates 2 and is connected to the anode terminal 42 formed on the first substrate 2. For example, the connecting member 44 can pass through an exhaust hole 46 formed on the first substrate 2 and is connected to the anode terminal 42. That is, the connecting member 44 passes the coupling portion of an exhaust tube 48 and is connected to the anode terminal 42.

In the above description, the present invention is applied to the electron emission display having an array of FEA elements. However, the present invention is not limited to this application. For example, the present invention can be applied to an electron emission display having an array of SCE elements.

According to the present invention, since the anode terminal for supplying an anode voltage is formed on the first substrate, the space taken by the anode terminal on the second substrate can be eliminated. Therefore, the unnecessary area other than the active area can be reduced in the electron emission display.

Furthermore, since the terminals for supplying the voltage are arranged on the first substrate, a possibility of the anode terminal overlapping the frit glass on the second substrate can be reduced. Therefore, the leakage from the vacuum envelope of the electron emission display can be reduced.

Although exemplary embodiments of the present invention have been described in detail hereinabove, it should be clearly understood that many variations and/or modifications of the basic inventive concept taught herein still fall within the spirit and scope of the present invention as defined by the appended claims.

What is claimed is:

1. An electron emission display device, comprising:

first and second substrates facing each other and coupled to each other by a sealing member to define a vacuum envelope;

an electron emission unit arranged on the first substrate; and a light emission unit arranged on the second substrate, the light emission unit including an anode electrode arranged on the second substrate and electrically connected to at least one anode terminal in order to receive an anode voltage from the anode terminal, an entirety of the anode terminal being arranged directly on a surface of the first substrate facing the second substrate, and with at least a portion of the anode terminal exposed to an exterior of the vacuum envelope and the anode terminal disposed parallel to the first substrate.

2. The electron emission display device of claim 1, wherein a lead line connected to the anode terminal is arranged on the first substrate within the vacuum envelope, and wherein the lead line and the anode electrode are electrically interconnected by a connecting member.

3. The electron emission display device of claim 2, wherein the connecting member contacts a part of the anode electrode.

4. The electron emission display device of claim 2, wherein the connecting member contacts an extending portion of the anode electrode.

5. The electron emission display device of claim 4, wherein a crossed region is defined where the extending portion faces the lead line, and wherein the connecting member is arranged within the crossed region.

6. The electron emission display device of claim 4, wherein the extending portion comprises a plurality of individual extending portions.

7. The electron emission display device of claim 6, wherein the extending portion crosses the lead line at right angles.

8. The electron emission display device of claim 2, wherein the lead line comprises a material selected from a group consisting of Cr, Al, Ag, ITO, and combinations thereof.

9. The electron emission display device of claim 4, wherein the extending portion comprises a material selected from a group consisting of Cr, Al, Ag, ITO, and combinations thereof.

10. The electron emission display device of claim 2, wherein the connecting member is fixed to at least one of the anode electrode and the lead line by an electrically conductive adhesive.

11. The electron emission display device of claim 2, wherein the connecting member comprises an electrically conductive spacer.

12. The electron emission display device of claim 2, wherein the connecting member comprises an electrically conductive elastic body.

13. The electron emission display device of claim 12, wherein the connecting member comprises a coil spring.

14. The electron emission display device of claim 12, wherein the connecting member comprises a spring having a diamond-shaped cross-section.

15. The electron emission display device of claim 12, wherein the connecting member comprises a leaf spring having a bent centerline.

16. The electron emission display device of claim 2, wherein the connecting member comprises a resistive material.

17. The electron emission display device of claim 1, wherein the anode terminal is arranged close to the sealing member on the first substrate.

18. The electron emission display device of claim 17, wherein an edge of the first substrate is either coincident with an edge of the second substrate, or is arranged inside the edge of the second substrate.

19. The electron emission display device of claim 17, wherein the anode terminal is arranged on an extending portion of the first substrate, which extends to a side of the second substrate external to the vacuum envelope.

20. The electron emission display device of claim 1, wherein the anode terminal contacts the anode electrode and is electrically connected to a connecting member passing through an exhaust hole arranged on the first substrate.

* * * * *